US009126308B2

(12) United States Patent
Yamamoto

(10) Patent No.: US 9,126,308 B2
(45) Date of Patent: Sep. 8, 2015

(54) SHOT-PROCESSING APPARATUS

(75) Inventor: Masatoshi Yamamoto, Toyakawa (JP)

(73) Assignee: SINTOKOGIO, LTD., Aichi (JP)

( * ) Notice: Subject to any disclaimer, the term of this patent is extended or adjusted under 35 U.S.C. 154(b) by 219 days.

(21) Appl. No.: 13/882,376

(22) PCT Filed: May 31, 2011

(86) PCT No.: PCT/JP2011/062475
§ 371 (c)(1),
(2), (4) Date: Apr. 29, 2013

(87) PCT Pub. No.: WO2012/060125
PCT Pub. Date: May 10, 2012

(65) Prior Publication Data

US 2013/0327105 A1 Dec. 12, 2013

(30) Foreign Application Priority Data

Nov. 1, 2010 (JP) ..... 2010-245352

(51) Int. Cl.
*B24C 1/10* (2006.01)
*B24C 3/24* (2006.01)

(52) U.S. Cl.
CPC .... *B24C 1/10* (2013.01); *B24C 3/24* (2013.01)

(58) Field of Classification Search
CPC ..... B24C 1/10; B24C 3/24
See application file for complete search history.

(56) References Cited

U.S. PATENT DOCUMENTS

| | | | | |
|---|---|---|---|---|
| 5,029,419 | A | 7/1991 | Nakayama et al. | |
| 5,272,897 | A | 12/1993 | Wern | |
| 6,315,646 | B1 * | 11/2001 | Hoyashita | 29/90.7 |

FOREIGN PATENT DOCUMENTS

| | | |
|---|---|---|
| JP | 01-271175 | 10/1989 |
| JP | 2-4755 | 1/1990 |
| JP | 02-306875 | 12/1990 |
| JP | 3-55157 | 5/1991 |
| JP | 08-323630 | 12/1996 |
| JP | 2002-096264 | 4/2002 |

OTHER PUBLICATIONS

English-language International Search Report from the Japanese Patent Office for International Application No. PCT/JP2011/062475, mailing date Sep. 6, 2011.
Extended European Search Report for EP Application No. 11837778.7 dated Mar. 2, 2015.

* cited by examiner

*Primary Examiner* — David B Jones
(74) *Attorney, Agent, or Firm* — Finnegan, Henderson, Farabow, Garrett & Dunner, L.L.P.

(57) ABSTRACT

A large table 30 is rotatably disposed at a position within an area that includes a projected area toward which shot is projected and a non-projected toward which no shot is projected. A plurality of small tables 32 are disposed on the large table 30. Each of the small tables 32 has a rotating shaft 33 that is parallel to the rotating shaft 31 of the large table 30. Thereby each of the small tables 32 can rotate. Workpieces 12 are placed on the small tables 32. A centrifugal projector 20 centrifugally accelerates shot to project it toward the workpieces 12 on the small tables 32. Each of the workpieces 12 on the small tables 32 is pressed down from above by the holding member 48 of the holding mechanism 46. The holding member 48 can rotate along with the workpiece 12.

7 Claims, 14 Drawing Sheets

(A)

(B)

SHOT-PROCESSING APPARATUS

TECHNICAL FIELD

This invention relates to a shot-processing apparatus that projects shot toward workpieces.

BACKGROUND OF THE INVENTION

A conventional shot-processing apparatus having a working table that is fixed on a rotating table that rotates in an approximately horizontal plane is known (for example, see Patent document 1). The apparatus projects shot toward a product (workpiece) that is placed on the working table while the rotating table is being caused to rotate.

Patent document 1: Japanese Patent Laid-open Publication No. 2002-96264

DISCLOSURE OF INVENTION

However, the apparatus requires a waiting time until the projection of the shot starts, because the apparatus cannot project shot while the product is being carried in.

In view of the above facts, the purpose of this invention is to obtain a shot-processing apparatus that can reduce the waiting time until the process starts while maintaining the stable quality of the workpieces that are to be processed by the projection of shot.

The shot-processing apparatus of claim 1 of the present invention comprises the following: a centrifugal projector that centrifugally accelerates shot to project it toward workpieces; a first rotatable table that is disposed at a position within an area that includes a projected area toward which the centrifugal projector projects shot and a non-projected area that is not the projected area; a plurality of second rotatable tables disposed on the first rotatable table, wherein the workpieces are placed on the plurality of second rotatable tables, and wherein each of the second rotatable tables has a rotating shaft that is parallel to a rotating shaft of the first rotatable table such that each of the second rotatable tables can rotate; and a holding mechanism that is disposed above the projected area on the first rotatable table, wherein the holding mechanism comprises a holding member that can press down one of the workpieces onto one of the second rotatable tables, and wherein the holding member can rotate along with one of the workpieces.

The shot-processing apparatus of claim 1 of the present invention is characterized in that the first rotatable table is rotatably disposed within the area that includes the projected area toward which the centrifugal projector projects shot and the non-projected area that is not the projected area. Further, the plurality of second rotatable tables are disposed on the first rotatable table. Each of the second rotatable tables has a rotating shaft that is parallel to the rotating shaft of the first rotatable table. Thereby each of them can rotate. The workpieces are placed on the second rotatable tables. Further, the centrifugal projector centrifugally accelerates shot to project it toward the workpieces on the second rotatable tables.

As discussed above, the holding mechanism is disposed above the projected area on the first rotatable table. The holding mechanism comprises the holding member. The holding member can press down a workpiece onto the second rotatable table. Further, the holding member can rotate along with the workpiece. So, shot is projected toward the workpiece while the workpiece is being caused to stably rotate. In addition, another workpiece can be carried in onto another second rotatable table that is disposed in the non-projected area on the first rotatable table during the projection of shot.

In addition to the configuration of the apparatus of claim 1, the shot-processing apparatus of claim 2 of the present invention further comprises a rotation-detecting device for detecting a rotation of the holding member.

As discussed above, the shot-processing apparatus of claim 2 of the present invention is characterized in that a rotation of the holding member is detected by means of the rotation-detecting device when the holding member rotates along with a workpiece. So, whether the workpiece is rotating can be checked. Namely, whether shot has been uniformly projected toward the entire workpiece can be checked.

In addition to the configuration of the apparatus of claim 1 or 2, the shot-processing apparatus of claim 3 of the present invention further comprises an index device and a control unit. The index device causes the first rotatable table to rotate by predetermined angles corresponding to the respective positions of the second rotatable tables and around the rotating shaft of the first rotatable table. Further, the index device disposes one of the second rotatable tables in the projected area on the first rotatable table while the first rotatable table is being caused to stop temporarily. The control unit stops the projection of shot from the centrifugal projector while the first rotatable table is being caused to rotate by means of the index device. Further, the control unit controls the centrifugal projector such that it projects shot while the first rotatable table is being cause to stop temporarily.

As discussed above, the shot-processing apparatus of claim 3 of the present invention is characterized in that the index device causes the first rotatable table to rotate by predetermined angles corresponding to the respective positions of the second rotatable tables and around the rotating shaft of the first rotatable table. Further, the index device disposes some of the second rotatable tables in the projected area on the first rotatable table while the first rotatable table is being caused to stop temporarily. The centrifugal projector is controlled by means of the control unit such that the centrifugal projector stops projecting shot while the first rotatable table is being caused to rotate by means of the index device. Further, the centrifugal projector is controlled by means of the control unit such that the centrifugal projector projects shot while the first rotatable table is being caused to stop temporarily. So, the leakage of shot can be reduced. Further, shot can be uniformly projected toward the entire workpiece.

In addition to the configuration of the apparatus of claim 3, the shot-processing apparatus of claim 4 of the present invention further comprises first engaging parts, a second engaging part, and an attaching and detaching mechanism. The first engaging parts are disposed below the second rotatable tables. The first engaging parts are formed on the respective rotating shafts of the second rotatable tables. The second engaging part is disposed below the projected area on the first rotatable table. The second engaging part can engage with each of the first engaging parts such that the second engaging part transmits rotational driving force to each of the first engaging parts while the second engaging part engages with each of the first engaging parts. The attaching and detaching mechanism attaches the second engaging part to each of the first engaging parts while the first rotatable table is being caused to stop temporarily. Further, the attaching and detaching mechanism detaches the second engaging part from each of the first engaging parts while the first rotatable table is being caused to rotate.

As discussed above, the shot-processing apparatus of claim 4 of the present invention is characterized in that the first engaging parts, which are disposed below the second rotatable tables, are formed on each of the rotating shafts of the second rotatable tables. The second engaging part, which is disposed below the projected area on the first rotatable table, can engage with each of the first engaging parts. The second engaging part transmits rotational driving force to each of the first engaging parts while the second engaging part engages with each of the first engaging parts. The attaching and detaching mechanism attaches the second engaging part to each of the first engaging parts while the first rotatable table is being caused to stop temporarily. Further, the attaching and detaching mechanism detaches the second engaging part from each of the first engaging parts while the first rotatable table is being caused to rotate. So, shot can be uniformly projected toward the entire workpiece while the first rotatable table is being caused to stop temporarily, because the workpiece stably rotates. Further, the first rotatable table can rotate smoothly while it is being caused to rotate.

In addition to the configuration of the apparatus of claim 4, the shot-processing apparatus of claim 5 of the present invention is characterized in that the attaching and detaching mechanism comprises an axial member and a cylinder mechanism. The second engaging part is disposed at the tip of the axial member. The cylinder mechanism can provide the axial member with a driving force that detaches the second engaging part from each of the first engaging parts.

As discussed above, the shot-processing apparatus of claim 5 of the present invention is characterized in that the second engaging part is disposed at the tip of the axial member of the attaching and detaching mechanism. Further, the cylinder mechanism of the attaching and detaching mechanism can provide the axial member with a driving force that detaches the second engaging part from each of the first engaging parts. So, the second engaging part can be attached to and detached from each of the first engaging parts by means of the simple configuration.

In addition to the configuration of the apparatus of claim 5, the shot-processing apparatus of claim 6 of the present invention is characterized in that a driving motor for driving the second engaging part is disposed below the axial member. Further, the driving motor causes the axial member to rotate via a mechanism for transmitting driving force.

The shot-processing apparatus of claim 6 of the present invention can be made smaller, because the driving motor for driving the second engaging part is disposed below the axial member, and the driving motor causes the axial member to rotate via the mechanism for transmitting driving force.

In addition to the configuration of the apparatus of claim 6, the shot-processing apparatus of claim 7 of the present invention is characterized in that the cylinder mechanism is disposed below the driving motor. Further, the axial direction of the cylinder mechanism is parallel to the axial direction of the driving motor.

The shot-processing apparatus of claim 7 of the present invention is characterized in that the apparatus can be made even smaller, because the cylinder mechanism is disposed below the driving motor, and the axial direction of the cylinder mechanism is parallel to the axial direction of the driving motor.

In addition to the configuration of any of claims 1 to 7, the shot-processing apparatus of claim 8 of the present invention is characterized in that the first rotatable table is partitioned into a plurality of areas along the circumferential direction of the first rotatable table by a plurality of partitioning members. The plurality of areas alternately comprise a first area on which each of the second rotatable tables is placed and a second area on which no second rotatable table is placed, along the circumferential direction of the first rotatable table.

The shot-processing apparatus of claim 8 of the present invention can effectively reduce the leakage of shot, because the first rotatable table is partitioned into a plurality of areas that are disposed along the circumferential direction of the first rotatable table by a plurality of partitioning members. The plurality of areas alternately comprise a first area on which each of the second rotatable tables is placed and a second area on which no second rotatable table is placed, along the circumferential direction of the first rotatable table.

In addition to the configuration of the apparatus of any of claims 1 to 8, the shot-processing apparatus of claim 9 of the present invention further comprises a spraying device that can spray gas toward a workpiece. Further, the spraying device is disposed such that its nozzle can face the workpiece and is located at a downstream position relative to the projected area on the first rotatable table along the direction of the rotation of the first rotatable table.

As discussed above, the shot-processing apparatus of claim 9 of the present invention comprises the spraying device that can spray gas toward a workpiece. Further, the spraying device is disposed such that its nozzle can face the workpiece and is located at a downstream position relative to the projected area on the first rotatable table along the direction of the rotation of the first rotatable table. So, the shot, etc., that remains on the workpiece is blown out by spraying gas from the spraying device.

EFFECT OF THE INVENTION

As discussed above, the shot-processing apparatus of the present invention can reduce the waiting time until the process starts while maintaining the stable quality of the workpieces that are processed by the projection of shot.

BRIEF DESCRIPTION OF THE DRAWINGS

FIG. 9 (B) shows a state in which the second engaging part has been detached from the first engaging part.

PREFERRED EMBODIMENTS OF THE INVENTION

The First Embodiment

Below, a shot-peening apparatus 10 that serves as the shot-processing apparatus of the first embodiment of the present invention is explained with reference to FIGS. 1 to 9. Incidentally, in the figures, the apparatus is illustrated in a state in which its outer plate is suitably removed (or in a state in which the outer plate is partially missing) so as to show the inside of the apparatus. Further, for example, the workpiece 12 that is processed by the shot-peening apparatus may be a product such as a gear.

Figure 1:
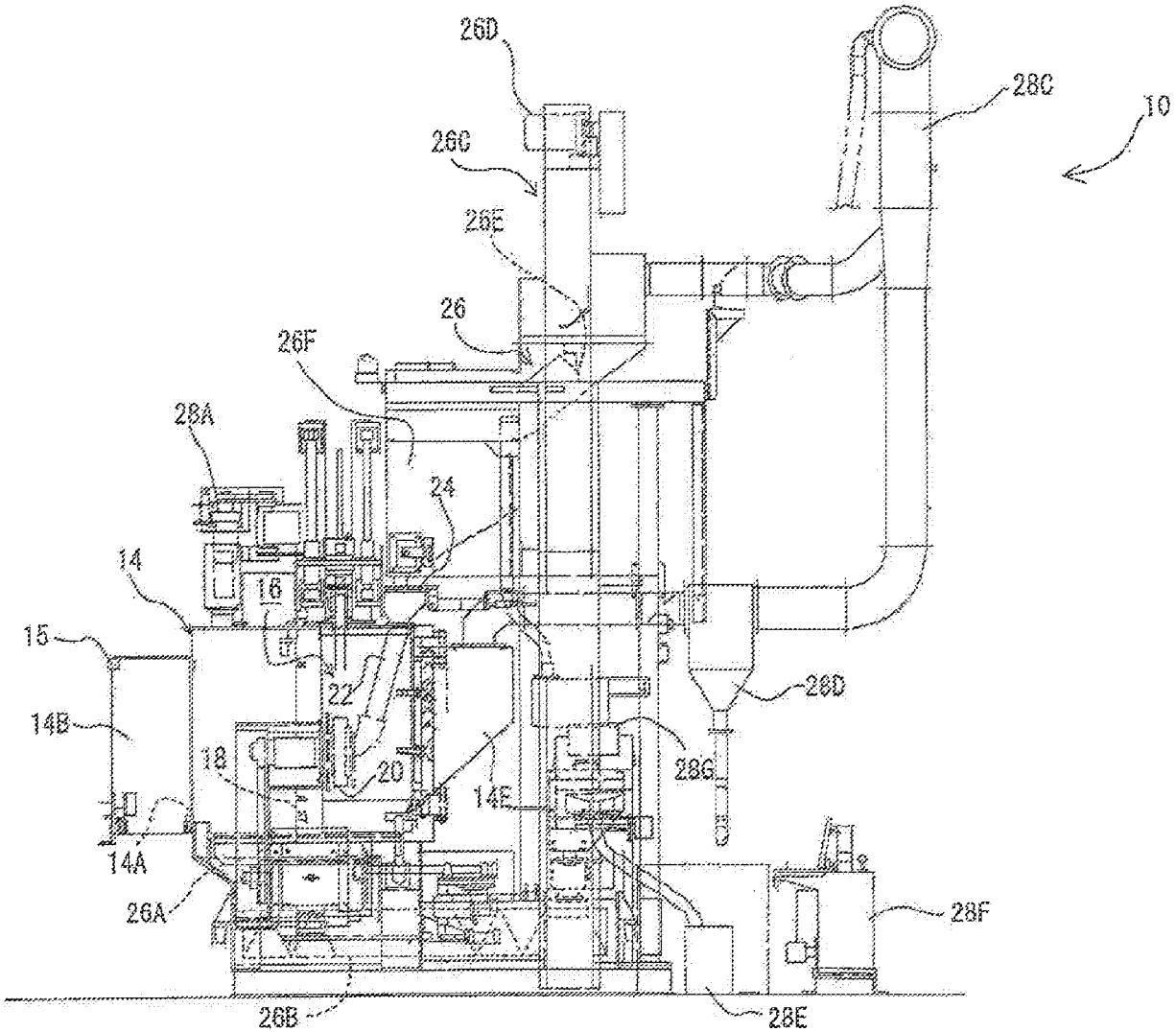
FIG. 1 is a front view of the shot-peening apparatus of the first embodiment of the present invention.
Figure 2:
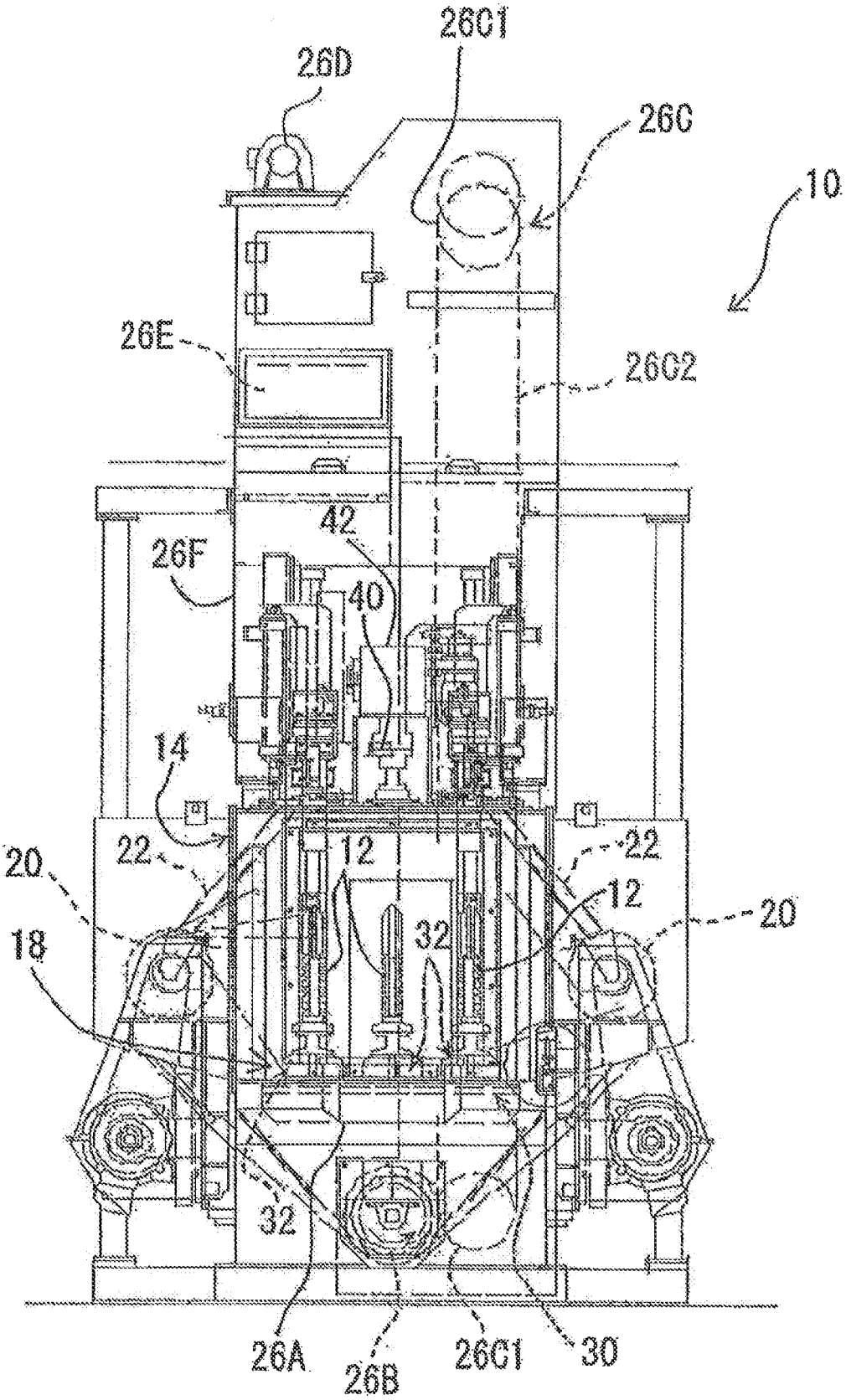
FIG. 2 is a left-side view of the shot-peening apparatus of the first embodiment of the present invention.
Figure 3:
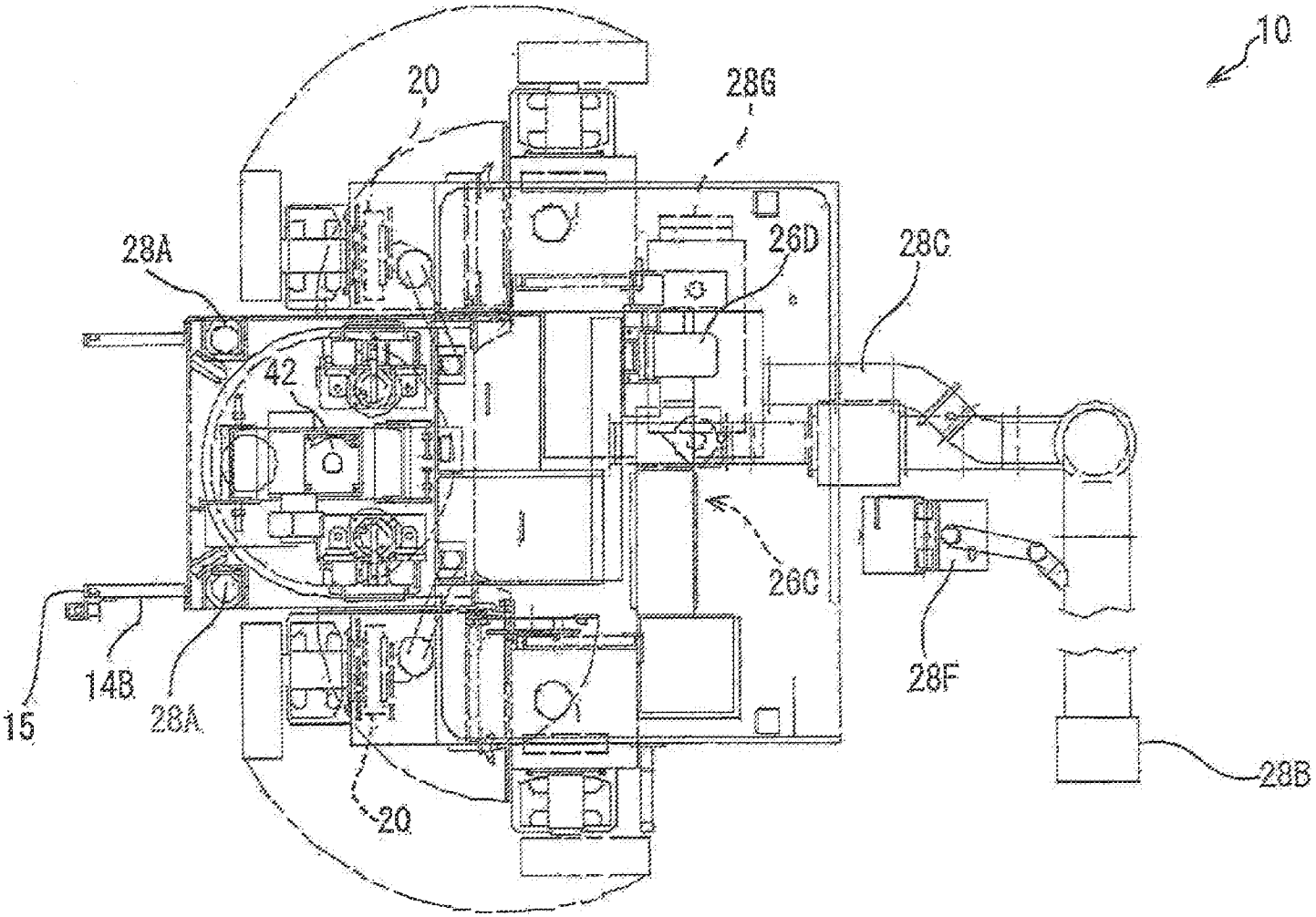
FIG. 3 is a plan view of the shot-peening apparatus of the first embodiment of the present invention.

A front view of the shot-peening apparatus 10 is shown in FIG. 1. A left-side view of the shot-peening apparatus 10 is shown in FIG. 2. A plan view of the shot-peening apparatus 10 is shown in FIG. 3.

As in FIG. 1, the shot-peening apparatus 10 comprises a cabinet 14. A projecting room 16, in which the surface of a workpiece 12 is processed by projecting shot toward it (see FIG. 2) is formed, in the cabinet 14. The cabinet 14 has an opening 14A for carrying in and taking out a workpiece 12. An opening and closing door 14B is attached to the opening 14A. An area sensor 15 (see FIG. 3) is attached to the opening and closing door 14B.

As in FIG. 2, a base for carrying products 18 on which a workpiece 12 is loaded is disposed at a lower part of the cabinet 14. Incidentally, the details of the base for carrying products 18 are explained below. A centrifugal projector 20 is disposed beside the cabinet 14. The centrifugal projector 20 can impart centrifugal force to a material to be projected (the material is shot, and, for example, may be a steel ball in this embodiment) by rotating a bladed wheel (an impeller). Namely, the centrifugal projector 20 projects shot toward a workpiece 12 in the projecting room 16 by accelerating it by centrifugal force. As in the schematic view of FIG. 8, the centrifugal projector 20 is connected to a control unit 64. As discussed below, the control unit 64 controls the timing of the projection of shot from the centrifugal projector 20.

As in FIG. 1, the lower end of an introducing pipe 22 for supplying shot is disposed above the centrifugal projector 20. A flow-regulating device 24 for adjusting the flow rate of shot is disposed at the upper end of the introducing pipe 22. The centrifugal projector 20 is connected to a circulating device 26 via the introducing pipe 22 and the flow-regulating device 24. The circulating device 26 transports the shot that was projected by the centrifugal projector 20 back to the centrifugal projector 20. The circulating device 26 comprises a hopper 26A for collecting shot at a position that is below the base 18 for carrying products and that is in the cabinet 14. A screw conveyor 26B is disposed below the hopper 26A.

The screw conveyor 26B is horizontally disposed such that the longitudinal direction of it is parallel to the left-right direction in FIG. 1. The screw conveyor 26B transports the shot that have fallen from the hopper 26A in a predetermined direction that is parallel to the longitudinal direction of the screw conveyor 26B. The lower end of a bucket elevator 26C that extends vertically in the apparatus is disposed at a downstream position in the direction in which the screw conveyor 26B transports shot (approximately at the center in the right-left direction of the apparatus in FIG. 1). The details of the structure of the bucket elevator 26C are omitted; since it is publicly known as in FIG. 2. An endless belt 26C2 is wound around the pulleys 26C1. The pulleys 26C1 are disposed a an upper part and a lower part of the shot-peening apparatus 10. Many buckets (not illustrated) are attached to the endless belt 26C2. The pulleys 26C1 are connected to a driving motor 26D via a mechanism for transmitting driving force (not illustrated) (for example, an endless belt, etc.) such that they can be driven. By means of the buckets, the bucket elevator 26C raises the (temporarily stored) shot that was collected by the screw conveyor 26B. The shot in the buckets is transported to a position above the cabinet 14 by rotating the pulleys 26C1 by means of the driving motor 26D.

As in FIG. 1, a separator 26E is disposed at a position near the upper part of the bucket elevator 26C. The separator 26E communicates with a tank 26F for storing materials to be projected. The separator 26E transports only usable shot from the shot that is raised by the bucket elevator 26C back to the tank 26F. The tank 26F supplies shot to the flow-regulating device 24. The tank 26F is disposed above the flow-regulating device 24.

A ventilator 28A (a ventilating device) is disposed above the cabinet 14. A duct 28C is connected to an suction hole 14E of the cabinet 14. The dust generated in the cabinet 14 is auctioned from the suction hole 14E of the cabinet 14. A settling chamber 28D is attached to one position in the route of the duct 28C. The settling chamber 28D generates a classifying flow in the suctioned air containing dust to remove the particulates in the auctioned air. A box 28E for receiving coarse powder is disposed below the settling chamber 28D. The coarse powder that is separated by the settling chamber 28D enters the box 28E. As in FIG. 3, a dust collector 28B (this is schematically shown in the figure) is connected to the duct 28C. The dust collector 28B filters the air that passed through the settling chamber 281) (see FIG. 1) and the duct 28C to discharge from the apparatus only the dust in the air.

Incidentally, a precoating device 28F is connected to the duct 28C. The precoating device 28F coats flammable dust such that it can be discharged while it is being kept nonflammable.

As in FIG. 1, a classifying screen 28G is connected to the box 28E for receiving coarse powder via a pipe. The classifying screen 28G is connected, via a pipe, to the tank 26F for storing materials to be projected. Further, the classifying screen 28G is connected to a passage that extends to a position near the lower end of the bucket elevator 26C. The usable shot in the shot that flows from the tank 26F into the classifying screen 28G is caused to flow toward the lower part of the bucket elevator 26C by the classifying screen 28G. Further, the separated fine powder is caused to flow into the box 28E by the classifying screen 28G.

Figure 4:
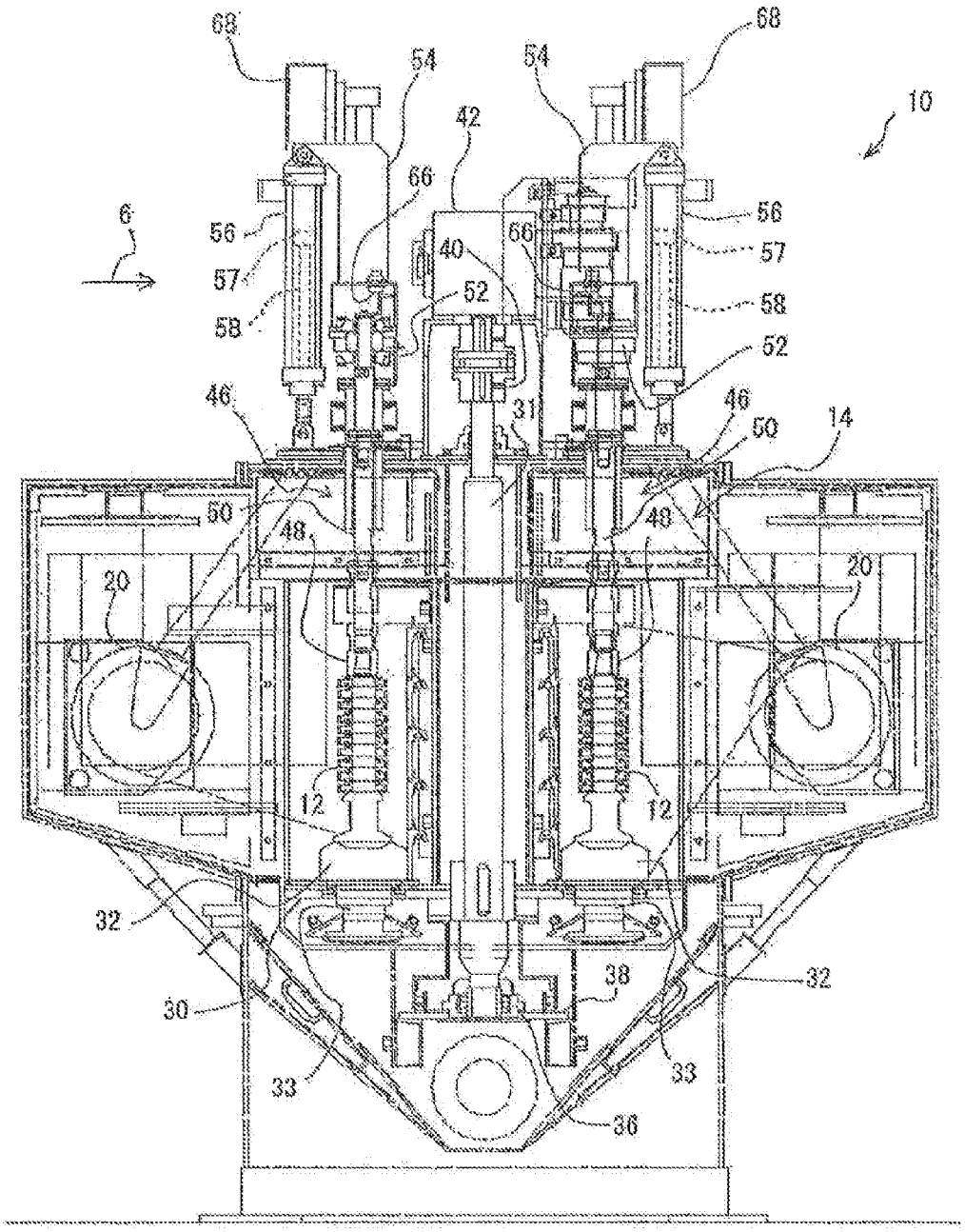
FIG. 4 is a left-side sectional view of the important part of the shot-peening apparatus of the first embodiment of the present invention.
Figure 5:
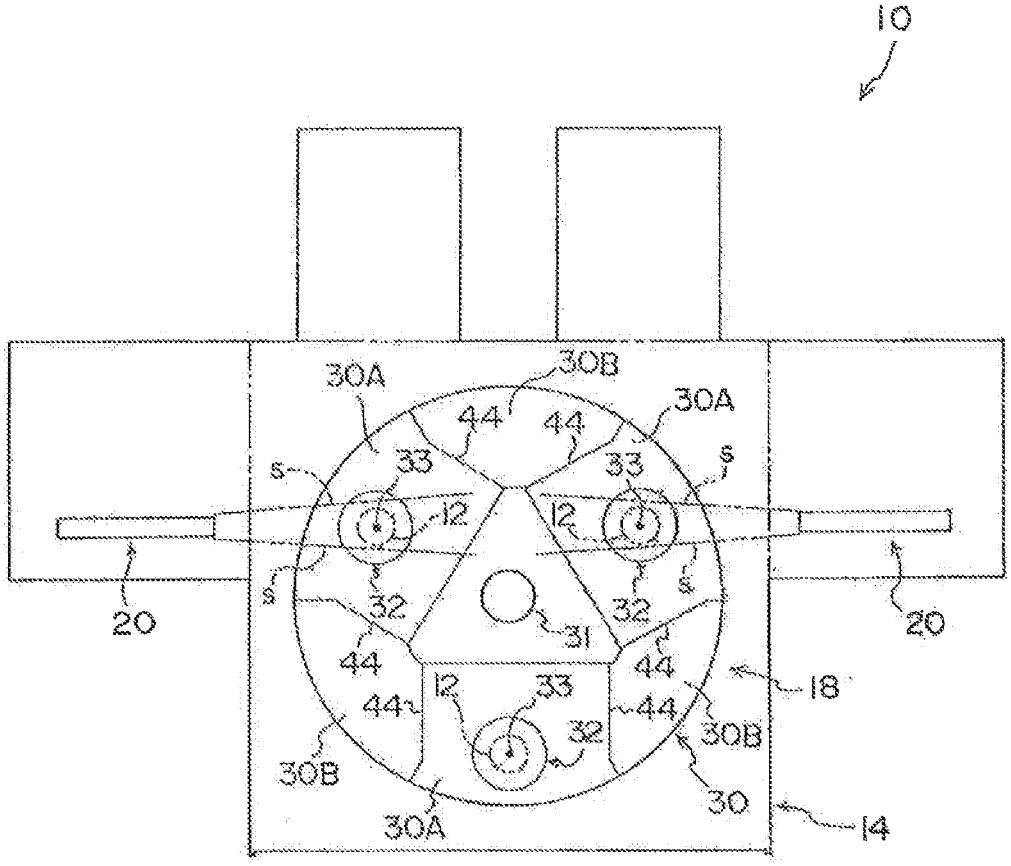
FIG. 5 is a cross-sectional plan view schematically illustrating the configuration of a base for carrying products, etc.

Next, the base 18 for carrying products is explained in detail. FIG. 4 is a left-side sectional view of the important part of the shot-peening apparatus 10. FIG. 5 is a plan cross-sectional view schematically illustrating the configuration of the base 18 for carrying products.

As in FIG. 5, a large table 30 that serves as the first rotatable table is disposed on the base 18. Further, on the large table 30, a plurality of small tables 32 that serve as the plurality of second rotatable tables (three in this embodiment) are disposed at equal intervals along the direction of the circumference of the large table 30. Namely, the base 18 has a so-called multi-table structure. The large table 30 can rotate (spin) around a rotating shaft 31 that is parallel to the vertical direction of the apparatus. The large table 30 is disposed such that it is located in an area that includes a projected area toward which shot is projected by the centrifugal projector 20 and a non-projected area that is not the projected area (both sides of the projected area are shown by a two-dot chain line S in the figure). The small tables 32 each have a diameter less than that of the large table 30. The small tables 32 each have a rotating shaft 33 that is parallel to the rotating shaft 31 of the large table 30. Workpieces 12 are placed on the small tables 32.

As in FIG. 4, the lower end of the rotating shaft 31 of the large table 30 is disposed on a base part 38 via a bearing 36. The upper end of the rotating shaft 31 of the large table 30 is connected to the index device 42 via a torque limiter 40 (a mechanical joining device). The torque limiter 40 prevents excessive torque from acting on the index device 42.

The index device 42 is not illustrated in detail in the figure, since it is publicly-known. For example, the index device 42 comprises a motor having a decelerating device for driving the large table 30 at predetermined time intervals, a positioning clamp for positioning the large table 30, and a positioning cylinder for moving the positioning clamp. Thereby, the index device 42 carries the large table 30 on the base part 38 such that the large table 30 can rotate and stop at each predetermined position that is located at every predetermined angle and such that the large table 30 can be clamped at each of the positions. The index device 42 can cause the large table 30 to rotate around the rotating shaft 31 by a predetermined angle (120 degrees in this embodiment) corresponding to the number of small tables 32 (three in this embodiment). In other words, the index device 42 causes the large table 30 to rotate around the rotating shaft 31 of the large table 30 by a predetermined angle corresponding to the positions at which the small table 32 are disposed (rotating at every predetermined time interval). As in FIG. 5, the index device 42 is configured such that some of the small tables 32 (two of them in this embodiment) are disposed in the projected area on the large table 30 in a state in which the large table 30 is being caused to stop temporarily. Incidentally for example, a cam-type index device (for example, INDEXMAN [trademark], which is a product of CKD Corporation) and a motor with a decelerator as the index device 42, may be used.

Figure 8:
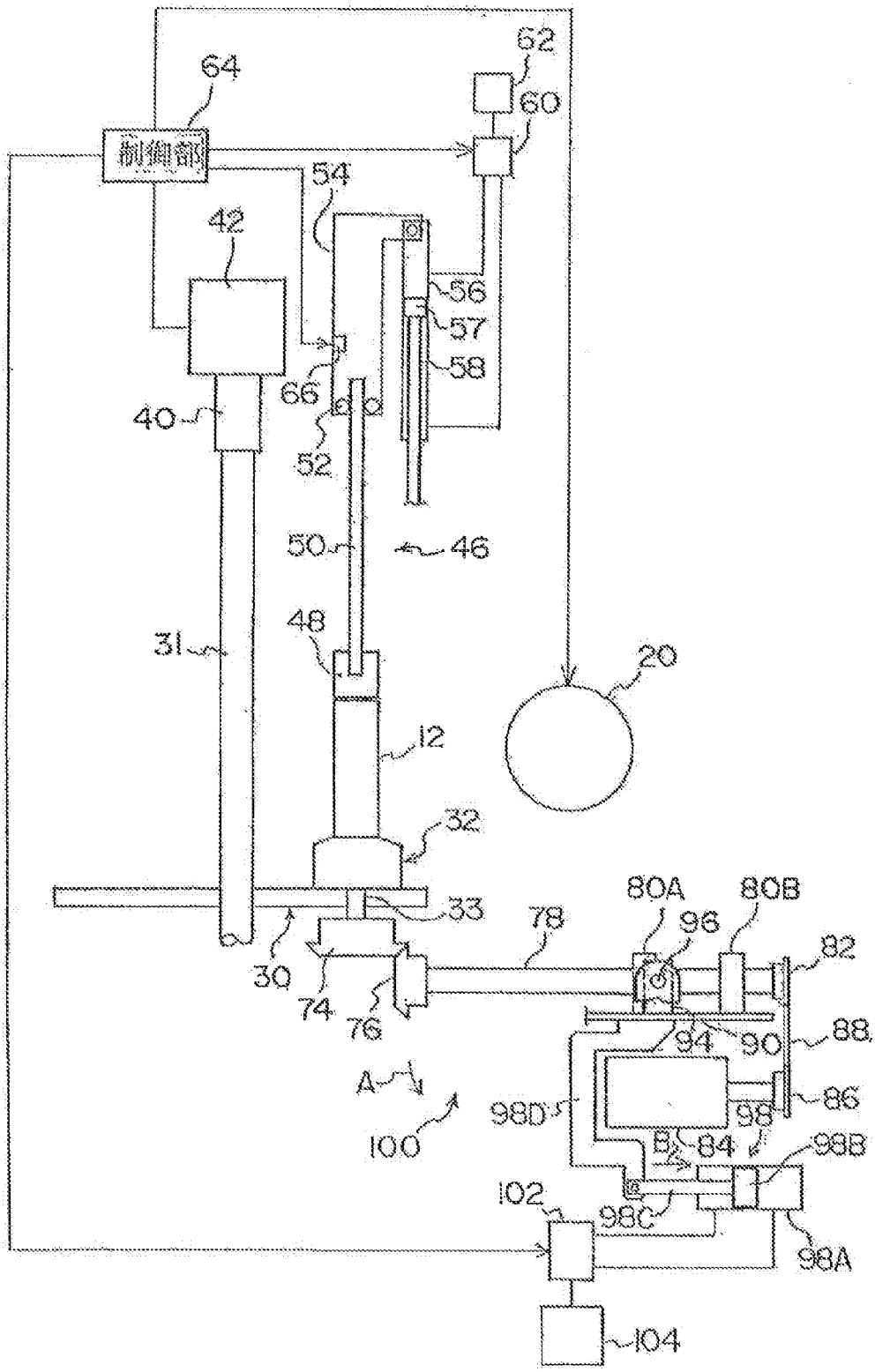
FIG. 8 is a schematic view illustrating the control of the operation of the shot-peening apparatus of the first embodiment of the present invention.
Figure 9:
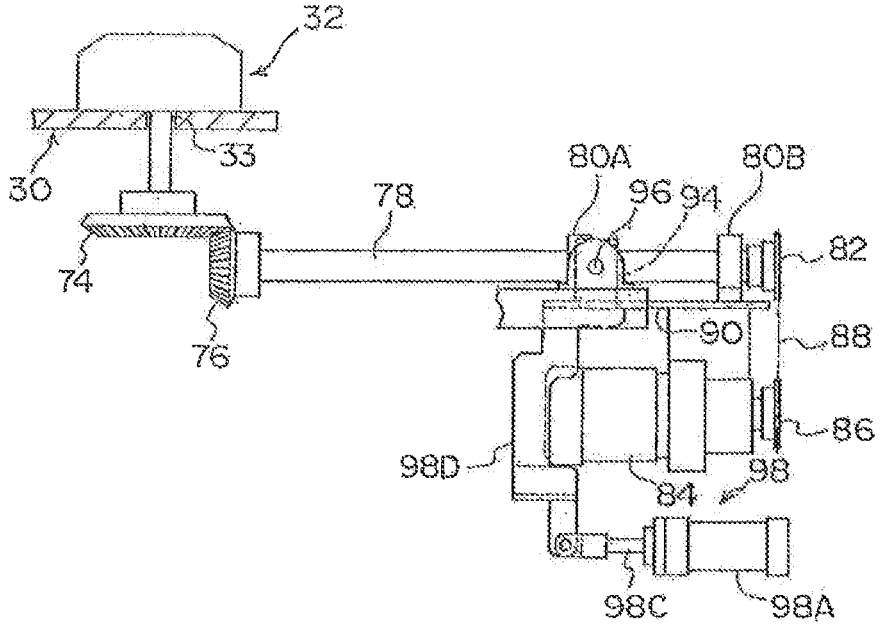
FIG. 9 is a schematic figure illustrating the operating state of the attaching and detaching mechanism of the shot-peening apparatus of the first embodiment of the present invention, FIG. 9 (A) shows a state in which the second engaging part contacts one of the first engaging parts.
Figure 9:
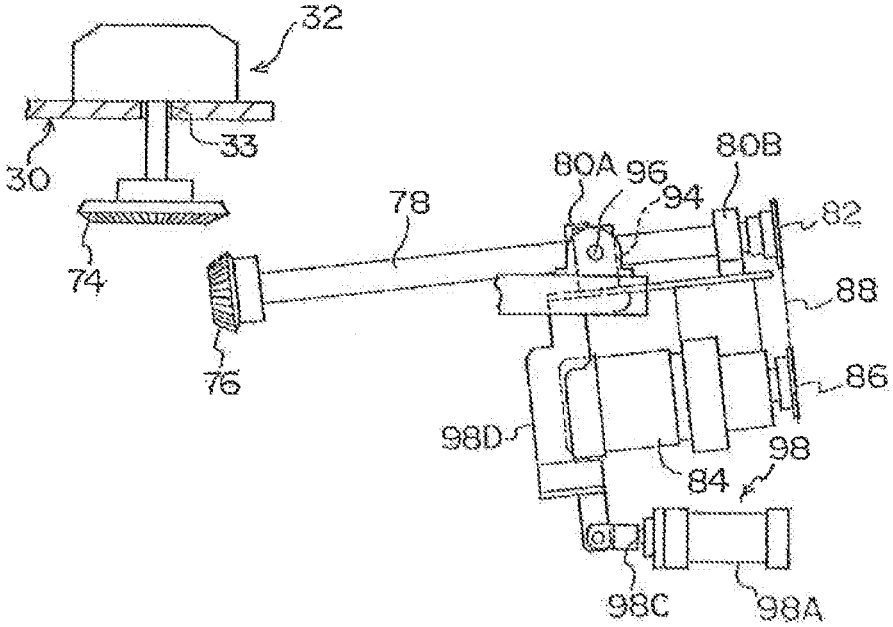

As in FIG. 8, the index device 42 is connected to the control unit 64. The control unit 64 controls the centrifugal projector 20 such that the projection from it is stopped while the large table 30 is being caused to rotate in a predetermined time interval by the index device 42 and such that the centrifugal projector 20 projects shot while the large table 30 is being caused to stop temporarily.

As in FIG. 5, some of the small tables 32 are disposed in a projected zone toward which shot is projected (the projected area) and the remaining small tables 32 are disposed in a loading and removing zone in which the small tables 32 are loaded and removed (the lower part in FIG. 5), while the large table 30 is being caused to stop temporarily. The surface of the large table 30 is partitioned into a plurality of areas (30A, 30B) that are disposed along the circumferential direction by a plurality of plate-like partitioning members 44 (six members in this embodiment). The plurality of areas (30A, 30B) alternately comprise a first area 30A, on which the small tables 32 are placed, and a second area 30B, on which no small table 32 is placed along the circumferential direction of the large table 30.

Incidentally, a sealing member for sealing the gap between each of the partitioning members 44 and its surrounding area may be disposed in the cabinet 14. The apparatus may have a controlling configuration for retracting the sealing member to a position at which the sealing member does not contact the partitioning members 44 while the large table 30 is being caused to rotate.

As in FIG. 4, a holding mechanism 46 (pressing fixture) is disposed above the projected area on the large table 30. The holding mechanism 46 comprises a holding member 48 for holding down from above a workpiece 12 on the small table 32. The holding member 48 is fixed to the lower end of a pressing shaft 50. The pressing shaft 50 consists of a plurality of shafts that are serially connected. The upper end of the pressing shaft 50 is supported by a bearing 52. The bearing 52 is disposed at the lower end of a first pressing frame 54. The pressing shaft 50 cannot move vertically relative to the first pressing frame 54 or the beating 52. The pressing shaft 50 can rotate relative to the first pressing frame 54 and the bearing 52. Thereby the holding member 48 can rotate along with the pressing shaft 50 around an axis parallel to the vertical direction of the apparatus. Also, the holding member 48 can rotate along with the workpiece 12 while the workpiece 12 is being held down. Incidentally, the lower part of the pressing shaft 50 is configured as an exchangeable component, since it is supposed to be abraded by shot (in other words, the plurality of shafts that are serially connected can be disassembled).

The lower end of the first pressing frame 54 is bent approximately at 90° and is fixed to the upper end of a cylinder 56. A rod 58 that is fixed to a piston 57 is disposed in the cylinder 56. The lower end of the rod 58 is attached to the ceiling part of the cabinet 14 via an attaching member. The cylinder 56 can move relative to the rod 58 (move vertically up and down) by means of the fluid pressure in the cylinder 56 (for example, air pressure in this embodiment). Namely, the holding mechanism 46 is configured such that the first pressing frame 54, the bearing 52, the pressing shaft 50, and the holding member 48 can also move up and down in the vertical direction of the apparatus in conjunction with the upward and downward movements of the cylinder 56. Incidentally, in this embodiment, the apparatus has a structure in which the cylinder 56 moves up and down by the rod 58 being attached to the ceiling part of the cabinet 14. However, the apparatus is not limited to that structure. For example, the apparatus may have a structure in which the piston and the rod are raised and lowered by the cylinder being attached to the ceiling part of the cabinet. Such a structure may be used to raise and lower the first pressing frame 54, etc.

As in FIG. 8, the holding mechanism 46 is configured such that the cylinder 56 is connected to an air-supplying source 62 via a device 60 for controlling the direction of air (an electromagnetic valve, etc.) and such that the device 60 is connected to the control unit 64. The control unit 64 can control the direction of the vertical movement of the cylinder 56 by controlling the device 60.

Figure 6:
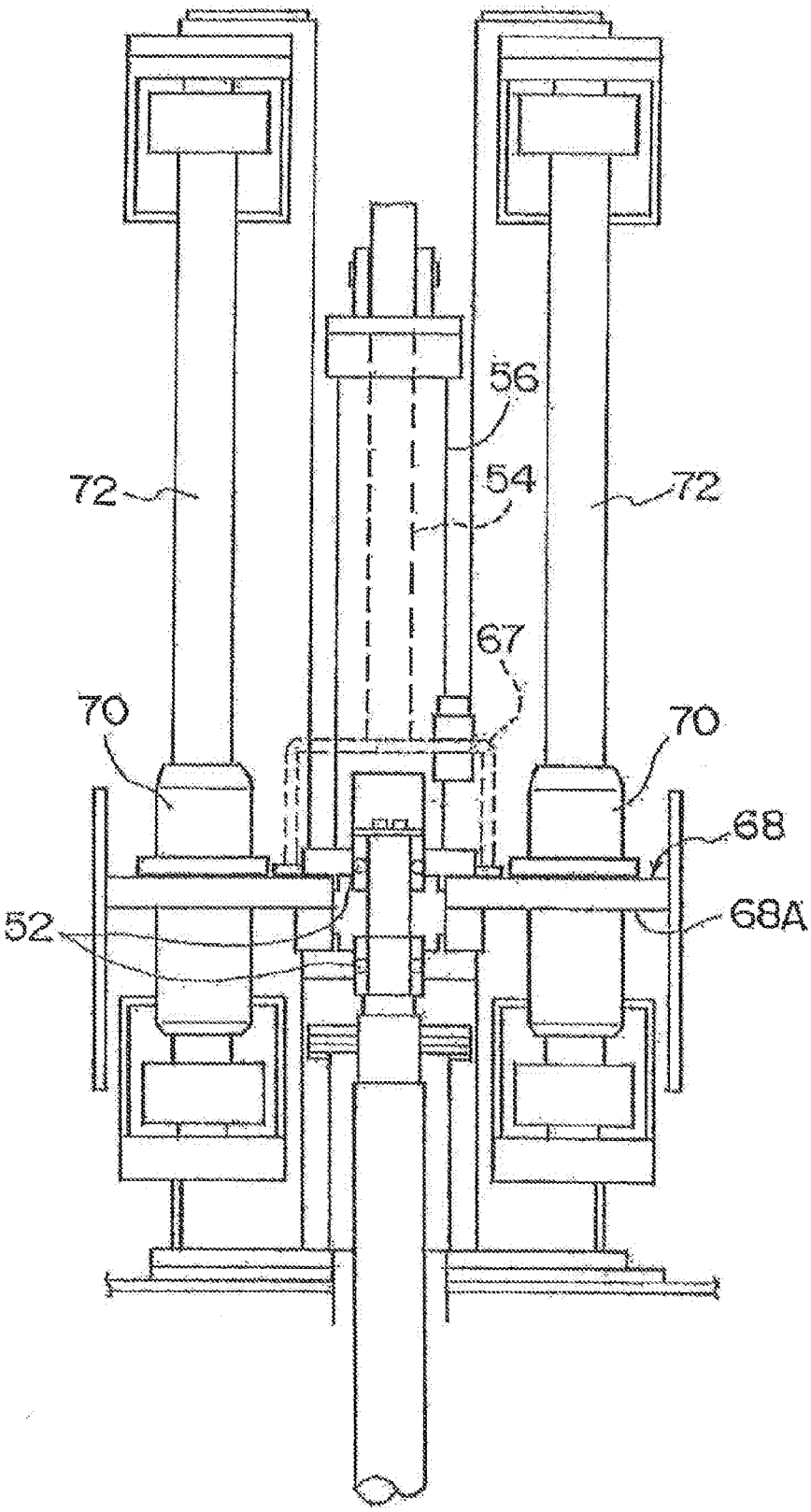
FIG. 6 is a schematic view of the holding mechanism that is shown by arrow 6 in FIG. 4.

As in FIG. 6, which illustrates the apparatus in the direction denoted by the arrow 6 in FIG. 4, the lower end of the first pressing frame 54 is fixed to a flat part 68A of a second pressing frame 68 via a connecting member 67 that opens downwardly. The flat part 68A of the second pressing frame 68 has through-holes at both sides of the first pressing frame 54, which is shown in FIG. 6. The cylindrical rod holders 70 are inserted into and fixed in the through-holes. The rod holders 70 can move up and down in the vertical direction of the apparatus along the guide rods 72 that extend vertically.

Namely, the apparatus has a structure in which the connecting member 67, the second pressing frame 68, and the rod holders 70, all move in conjunction with the movement of the first pressing frame 54, and in which the rod holders 70 move up and down in the vertical direction while they are guided by the guide rods 72, in a state in which the first pressing frame 54 moves up and down in the vertical direction of the apparatus. So, the first pressing frame 54, the bearing 52, the pressing shaft 50, and the holding member 48, which are all shown in FIG. 4, move stably in the vertical direction of the apparatus without moving horizontally.

By these configurations, the holding member 48 can move stably to a position that corresponds to an upper end of a workpiece 12. Further, the holding member 48 rotates along with a workpiece 12 when the workpiece 12 rotates around an axis of the vertical direction of the apparatus.

The holding mechanism 46 has a rotation-detecting sensor 66 that serves as the rotation-detecting device. The rotation-detecting sensor 66 is attached, at a position near the upper end of the pressing shaft 50, to the first pressing frame 54. The rotation-detecting sensor 66 can detect the rotation of the pressing shaft 50. In other words, the rotation-detecting sensor 66 can detect the rotation of the holding member 48. As in FIG. 8, the rotation-detecting sensor 66 is connected to the control unit 64. The control unit 64 controls a warning member (not illustrated) such that it warns the operator of the apparatus of this invention that the workpiece 12 is not rotating, if the rotation of the holding member 48 is not detected by the rotation-detecting sensor 66 while the large table 30 stops temporarily (in other words, in the period during which the holding member 48 should rotate). Incidentally the control unit 64 determines whether the large table 30 stops temporarily based on the information obtained from the index device 42. Further, the warning member warns the operator of the apparatus of this invention by turning on a warning display or by sounding an alarm buzzer.

As in FIG. 7, a first engaging part 74 is disposed below the small table 32. The first engaging part 74 is fixed to the lower end of the rotating shaft 33 such that the rotational axis of the first engaging part 74 coincides with the axis of the rotation of the rotating shaft 33. The first engaging part 74 is formed to have a shape similar to a bevel gear. Also, a second engaging part 76, which can engage with the first engaging part 74, is formed below the projected area on the large table 30. The second engaging part 76 is also formed to have a shape similar to a bevel gear. Namely, the first engaging part 74 and the second engaging part 76 constitute an engaging mechanism similar to a gear mechanism. Incidentally, the engaging mechanism comprising the first engaging part 74 and the second engaging part 76 is configured to have sufficiently large gap such that those parts do not slip even if those parts engage while shot exists between the gap.

The second engaging part 76 has a diameter less than that of the first engaging part 74. The second engaging part 76 is fixed to the tip of a shaft 78 that serves as an axial member such that the axis of the rotation of the second engaging part 76 coincides with the axis of the rotation of the shaft 78. Incidentally, in this embodiment, the second engaging part 76 has a diameter less than that of the first engaging part 74. However, the second engaging part 76 may have a diameter equivalent to the diameter of the first engaging part 74 (in other words, a pair of miter gears having the same number of teeth can be used). The shaft 78 is rotatably supported by the bearings 80A and 80B. A chain wheel 82 is attached to the end that is opposite the second engaging part 76. Below the shaft 78, a driving motor 84 having a decelerating device is disposed at a position that is closer to the chain wheel 82 than the center of the length of the shaft 78. The driving motor 84 is fixed to the lower surface of a mounting board 90 via a fixing means, etc. A chain wheel 86 is fixed to the axial member of the driving motor 84 such that the axis of the rotation of the chain wheel 86 coincides with the axial member. The chain wheel 86 is disposed below the chain wheel 82. Further, an endless chain 88 is wound around the chain wheels 82 and 86. Thereby the driving motor 84 causes the second engaging part 76 to rotate around its axis by rotating the shaft 78 via the chain wheel 86, the chain 88, and the chain wheel 82, which together serve as a mechanism for transmitting driving force. The second engaging part 76 transmits rotational driving force to the first engaging part 74, in a state in which the second engaging part 76 engages with the first engaging part 74.

An attaching and detaching mechanism 100 for causing the second engaging part 76 to attach to and detach from the first engaging part 74 is connected to the second engaging part 76. The attaching and detaching mechanism 100 includes the shaft 78. The mechanism 100 causes the second engaging part 76 to contact the first engaging part 74 while the large table 30 stops temporarily. Also, the mechanism 100 causes the second engaging part 76 to detach from the first engaging part 74 while the large table 30 is being caused to rotate. Below, the attaching and detaching mechanism 100 is explained.

The bearings 80A and 80B, which support the shaft 78, are fixed on the mounting board 90. A pair of brackets 94 are disposed approximately at each side of the bearing 80A and are connected to the mounting board 90. Pins 96 are attached to the pair of brackets 94 such that the axes of the pins 96 coincide. The pins 96 extend vertically to the shaft 78 as seen from above. The pins 96 are rotatably supported by pin-supporting members 97. The pin-supporting members 97 are disposed at symmetrical positions about the shaft 78. The pin-supporting members 97 are fixed to a longitudinal board 92 of the apparatus via connecting members 93.

In contrast, as in FIGS. 7 and 8, an air cylinder 98 that serves as the cylinder mechanism is disposed below the driving motor 84. The air cylinder 98 is disposed such that the axis of it is parallel to the direction of the axial member of the driving motor 84. The air cylinder 98 comprises a piston 98B and a cylinder 98A. The piston 98B is disposed in the cylinder 98A (see FIG. 8). The piston 98B can be reciprocated by air pressure (fluid pressure in a broad sense) in the cylinder 98A. The base end section of a rod 98C is fixed to the piston 98B. One end of an arm 98D is rotatably attached to the tip of the rod 98C. The other end of the arm 98D is attached to the lower surface of the mounting board 90. As seen from above, the position to which the arm 98D is attached is closer to the second engaging part 76 than the positions on the axes of the pins 96 are.

As in FIG. 8, the attaching and detaching mechanism 100 is configured such that the air cylinder 98 is connected to an air-supplying source 104 via a device 102 for controlling the direction of air (an electromagnetic valve, etc.) and such that the device 102 for controlling the direction of air is connected to the control unit 64. The control unit 64 can control the direction of the movement of the cylinder 98C by controlling the device 102 for controlling the direction of air based on the information obtained from the index device 42. As discussed above, in this embodiment, the attaching and detaching mechanism 100 is configured such that the air cylinder 98 can provide the shaft 78 with driving force that causes the second engaging part 76 to detach from the first engaging part 74 (in the direction denoted by the arrow A in FIG. 8). Depending on the driving force, the shaft 78 turns about the pins 96, which serve as a pivot such that the tip of the shaft 78 (one end at the side of the second engaging part 76) is lowered (see FIG. 9 (B)).

(Functions and Effects)

Next, the functions and effects of the apparatus of the embodiment are explained.

As in FIG. 5, the large table 30 is rotatably disposed at a position within an area that includes a projected area toward which the centrifugal projector 20 projects shot and a non-projected area that is not the projected area. The plurality of small tables 32 are disposed on the large table 30. Each of the small tables 32 has the rotating shaft 33. Each of the rotating shafts 33 is parallel to the rotating shaft 31 of the large table 30. The workpieces 12 are placed on the small tables 32. The centrifugal projector 20 projects shot toward the workpiece 12 on each of the small tables 32 by accelerating the shot by centrifugal force.

As in FIG. 4, the holding mechanism 46 is disposed above the projected areas on the large table 30. The workpiece 12 on each of the small tables 32 is pressed down from above by the holding member 48 of the holding mechanism 46. The holding member 48 can rotate along with the workpiece 12. So, shot is projected toward the workpiece 12 while it is being caused to stably rotate. The workpiece 12 can be carried onto, and taken out from, one of the small tables 32 (the lowest of the small tables 32 in FIG. 5) that is disposed in the non-projected area (an area for carrying in and taking out a workpiece) on the large table 30 shown in FIG. 5 while being projected.

In this embodiment, the rotation of the holding member 48 is detected by the rotation-detecting sensor 66 when the holding member 48, which is shown in FIG. 4, rotates along with the workpiece 12 on it. The control unit 64, which is shown in FIG. 8, controls the warning member (not illustrated) such that it warns the operator of the apparatus of this invention that the workpiece 12 is not rotating, if the rotation of the holding member 48 is not detected by the rotation-detecting sensor 66 while the large table 30 stops temporarily (in the period during which the holding member 48 should rotate). Incidentally, the control unit 64 determines whether the large table 30 is being caused to stop temporarily based on the information obtained from the index device 42 when the control unit 64 carries out the above control. Thereby the warning member can warn the operator of the apparatus of this invention by turning on a warning display or by sounding an alarm buzzer. So, whether shot has been uniformly projected toward the entire workpiece can be checked.

In this embodiment, the index device 42 causes the large table 30 to rotate, by a predetermined angle corresponding to the respective positions of the small tables 32, around the rotating shaft 31 of the large table 30. Some of the small tables 32 (two tables in this embodiment) are disposed in the projected area on the large table 30 while the large table 30 is being caused to stop temporarily. The control unit 64 controls the centrifugal projector 20 such that the projection of shot from the centrifugal projector 20 is stopped while the large table 30 is being caused to rotate by the index device 42. Further, the control unit 64 controls the centrifugal projector 20 such that it projects shot while the large table 30 is being caused to stop temporarily. So, the leakage of shot can be reduced. Further, shot can be uniformly projected toward the entire workpiece.

In this embodiment, the first engaging parts 74, which are disposed below the small tables 32, are fixed to the rotating shafts 33 of the small tables 32. The second engaging part 76, which is disposed below the projected area on the large table 30, can engage with any of the first engaging parts 74. The second engaging part 76 transmits a rotational driving force to the first engaging part 74 while the second engaging part 76 engages with the first engaging part 74. The attaching and detaching mechanism 100 causes the second engaging part 76 to contact the first engaging part 74 while the large table 30 stops temporarily. The attaching and detaching mechanism 100 causes the second engaging part 76 to detach from the first engaging part 74 while the large table 30 is rotating. So, shot can be uniformly projected toward the entire workpiece 12 while the large table 30 stops temporarily, because the workpiece 12 rotates stably. Further, the large table 30 can rotate smoothly while it is being caused to rotate.

In this embodiment, the second engaging part 76 is fixed to the tip of the shaft 78 of the attaching and detaching mechanism 100. The air cylinder 98 of the attaching and detaching mechanism 100 can provide the shaft 78 with driving force that causes the second engaging part 76 to detach from the first engaging part 74. More specifically, based on the information obtained from the index device 42, the control unit 64 retracts the rod 98C by controlling the device 102 for controlling the direction of air when the large table 30 begins to be caused to rotate by the index device 42. Thereby, the shaft 78 is pulled downwardly (in the direction denoted by the arrow A in FIG. 8) via the arm 98D, the mounting board 90, and the bearing 80A, when the rod 98C is retracted (in the direction denoted by the arrow B in FIG. 8). At the same time, the pair of brackets 94 that are connected to the mounting board 90 rotate around the axes of the pins 96. As a result, the attaching and detaching mechanism 100 changes from the state as in FIG. 9 (A) to the state as in FIG. 9 (B). Namely, the second engaging part 76, which is fixed at the tip of the shaft 78, is caused to detach from the first engaging part 74. Thus, the second engaging part 76 becomes disconnected from the first engaging part 74.

Based on the information obtained from the index device 42 shown in FIG. 8, the control unit 64 extends the rod 98C by controlling the device 102 for controlling the direction of air while the large table 30 is being caused to stop temporarily after it is caused to rotate by a predetermined angle. Thereby, the shaft 78 is pulled upwardly (in the direction opposite the arrow A in FIG. 8) via the arm 98D, the mounting board 90, and the bearing 80A, when the rod 98C is extended (in the direction opposite the arrow B in FIG. 8). At the same time, the pair of brackets 94 that are connected to the mounting board 90 rotate around the axes of the pins 96. As a result, the attaching and detaching mechanism 100 changes from the state as in FIG. 9 (B) to the state as in FIG. 9 (A). Namely, the second engaging part 76, which is fixed at the tip of the shaft. 78, is caused to contact the first engaging part 74. Thus, the second engaging part 76 becomes connected to the first engaging part 74.

So, the attachment and detachment of the first engaging part 74 and the second engaging part 76 can be achieved by a simple configuration. Further, the large table 30 and the small table 32 can be prevented from insufficiently rotating. Thereby the quality of the workpiece 12 that is processed by projecting shot is excellent.

As discussed above, the shot-peening apparatus 10 in this embodiment can reduce the waiting time until the processing of the workpiece 12 starts while maintaining the stable quality of the workpieces 12 that are processed by the projection of shot.

As in FIGS. 7 and 8, the driving motor 84, which causes the second engaging part 76 to rotate, is disposed below the shaft 78. Also, the driving motor 84 causes the shaft 78 to rotate via the chain wheel 86, the chain 88, and the chain wheel 82. Thereby the apparatus can be made smaller. In addition, the air cylinder 98 is disposed below the driving motor 84. The air cylinder 98 is disposed such that the axis of it is parallel to the direction of the axial member of the driving motor 84. Thereby the apparatus can be made even smaller.

As in FIG. 5, in this embodiment the surface of the large table 30 is partitioned into a plurality of areas (30A, 30B)

along the circumferential direction of the large table 30 by a plurality of partitioning members 44. The plurality of areas (30A, 30B) alternately comprise the first area 30A, on which each of the second rotatable tables 32 is placed, and the second area 30B, on which the no second rotatable table 32 is placed, along the circumferential direction of the first rotatable table. So, the leakage of shot can be efficiently reduced.

The Second Embodiment

Figure 10:
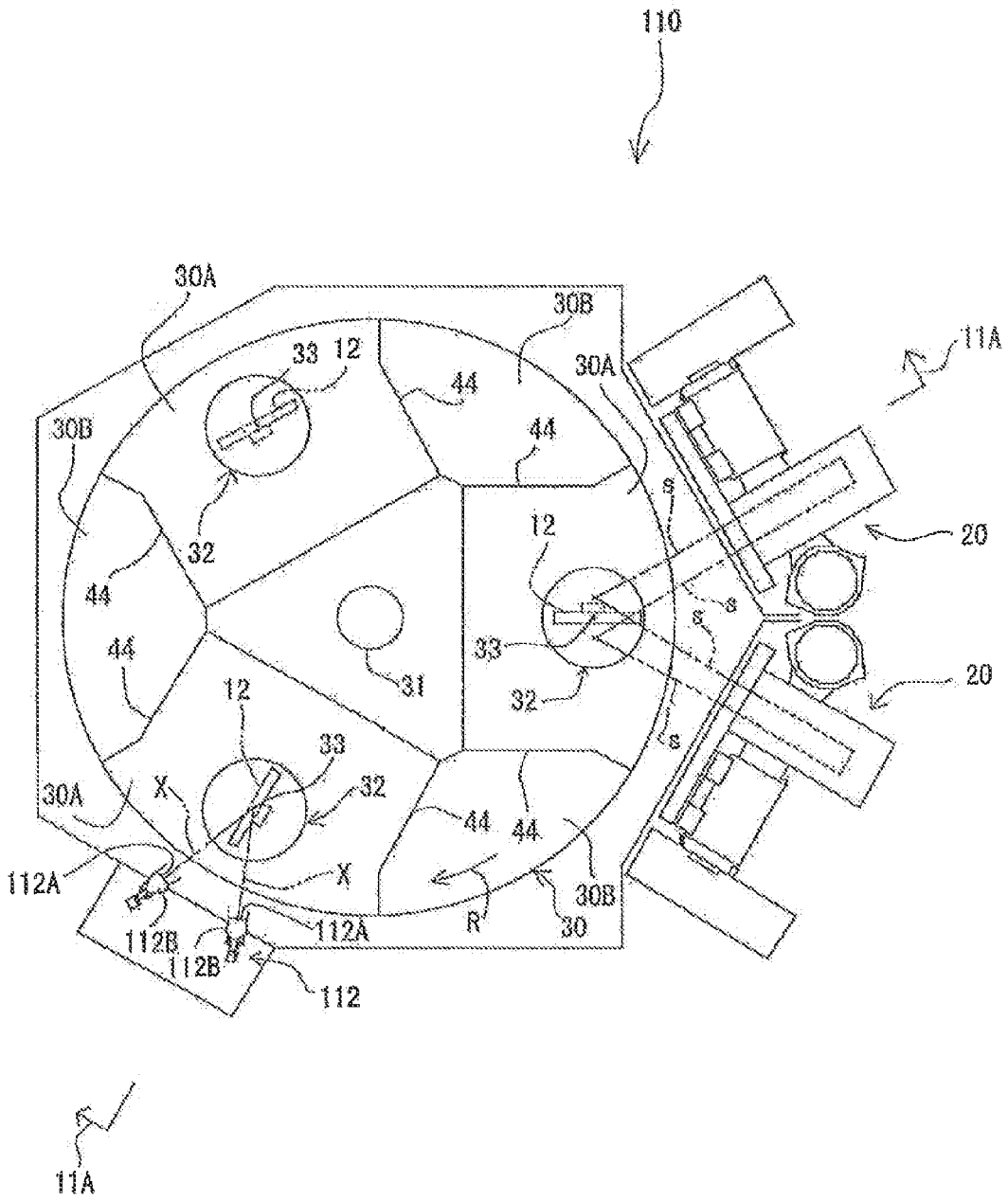
FIG. 10 is a plan view of the important section of the shot-peening apparatus of the second embodiment of the present invention.
Figure 11:
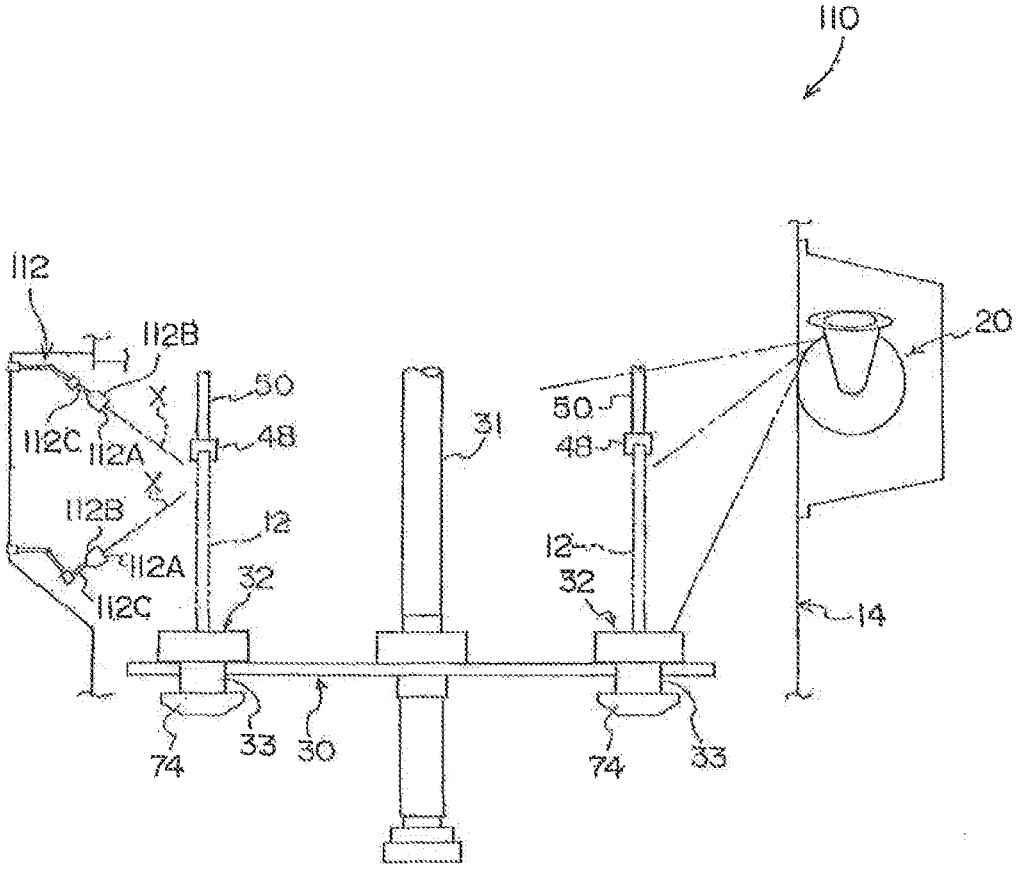
FIG. 11 is a longitudinal sectional view schematically illustrating the important section that corresponds to the cross section along the line 11A-11A in FIG. 10.

Next, the shot-peening apparatus 110, which serves as the shot-processing apparatus of the second embodiment of the present invention, is explained with reference to FIGS. 10 and 11. FIG. 10 is a plan view illustrating the important section of the shot-peening apparatus 110 of the second embodiment of the present invention. FIG. 11 is a longitudinal sectional view schematically illustrating the important section that corresponds to the cross section along the line 11A-11A in FIG. 10. Incidentally, the apparatus of this embodiment has the same configuration as those in the apparatus of the first embodiment, except for the points explained below. So, the explanations of the components that have essentially the same configurations as the configurations in the first embodiment are omitted. The same reference numbers used in the first embodiment are given to those components.

As in FIG. 10, two nozzles 112A of the spraying device 112 are disposed at downstream positions relative to the projected area on the large table 30 along the direction of the rotation of the large table 30 (along the direction denoted by the arrow R) such that the two nozzles face the workpiece. The spraying device 112 has a plurality of nozzles 112B. The nozzles 112B face a position at which any one of the small tables 32, which are disposed at outside positions on the large table 30, is disposed while the orbital movements of the small tables 32 are being caused to stop temporarily. As in FIG. 11, the nozzles 112B are connected to ducts 112C. Each of the ducts 112C is connected to a member for supplying compressed air (not illustrated).

Thereby, the spraying device 112 can spray gas (compressed air in this embodiment) toward the workpiece 12 (toward the route through which the workpiece 12 revolves). As in FIG. 10, some of the small tables 32 are disposed in the projected area (projection range) toward which shot is projected, some of the small tables 32 are disposed in an area toward which gas is sprayed, and the remaining small tables 32 are disposed in an area in which the loading and unloading of (small tables 32) is carried out, in a state in which the large table 30 is being caused to stop temporarily. Incidentally, in the figure, the sprayed gas is schematically denoted by the two-dot chain lines X. The spraying device 112 is connected to the control unit 64 (see FIG. 8). The control unit 64 (see FIG. 8) controls the spraying device 112 such that it sprays gas simultaneously while the centrifugal projector 20 projects shot.

The apparatus of this embodiment can effectively remove the shot that remains on the workpiece 12 in addition to achieving the functions and effects by the apparatus of the first embodiment.

The Third Embodiment

Figure 12:
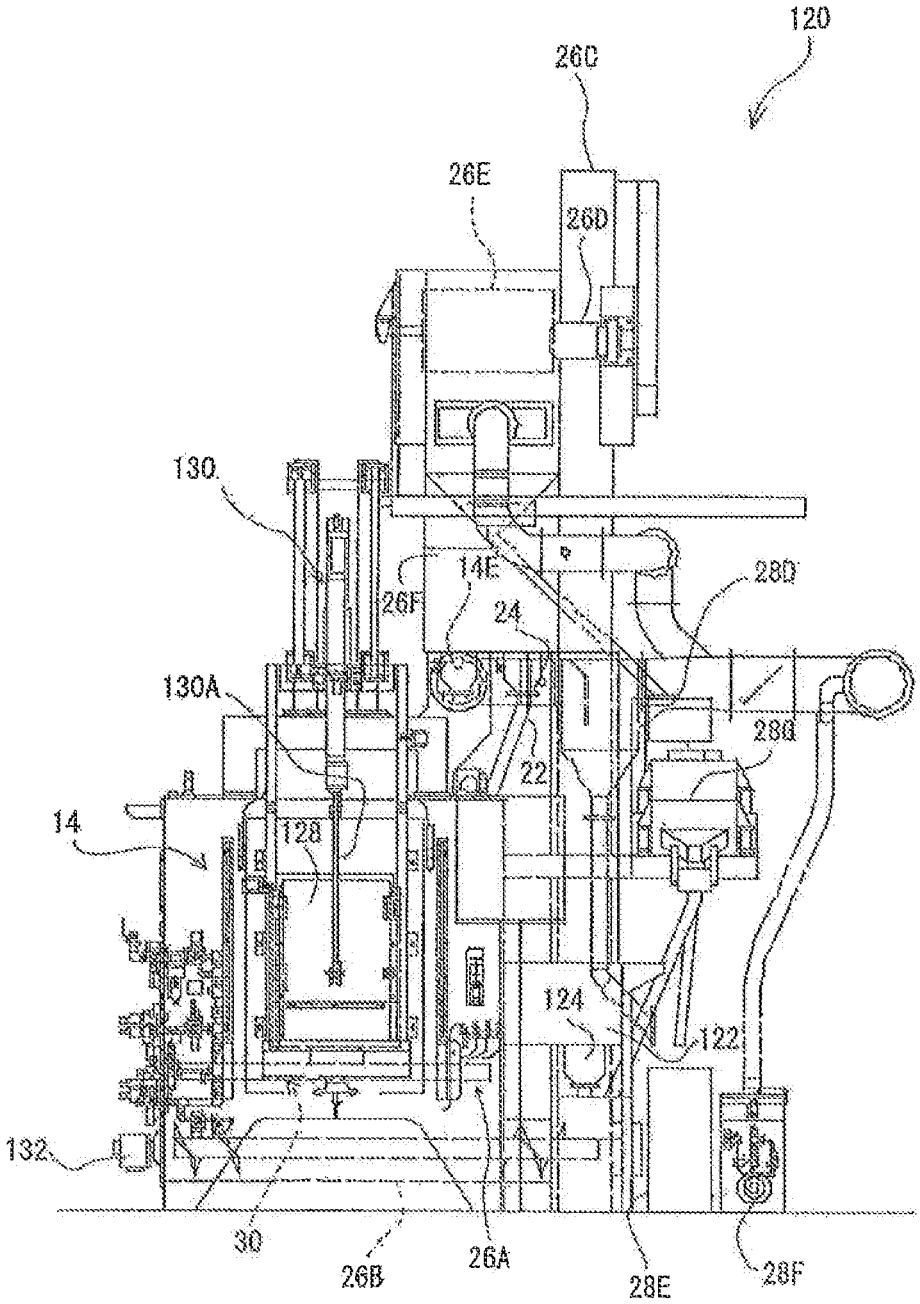
FIG. 12 is a front view of the shot-peening apparatus of the third embodiment of the present invention.
Figure 13:
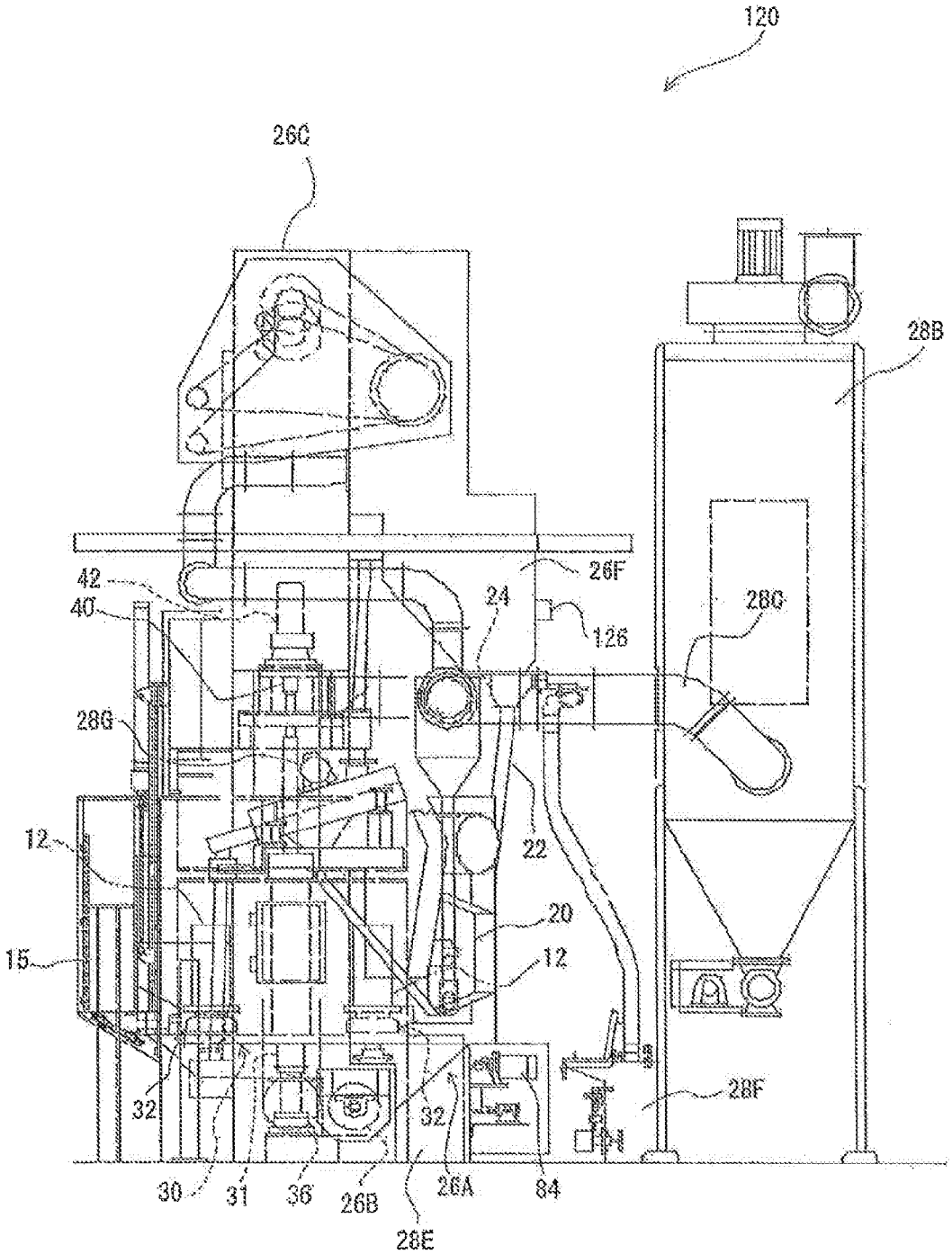
FIG. 13 is a right-side view of the shot-peening apparatus of the third embodiment of the present invention.
Figure 14:
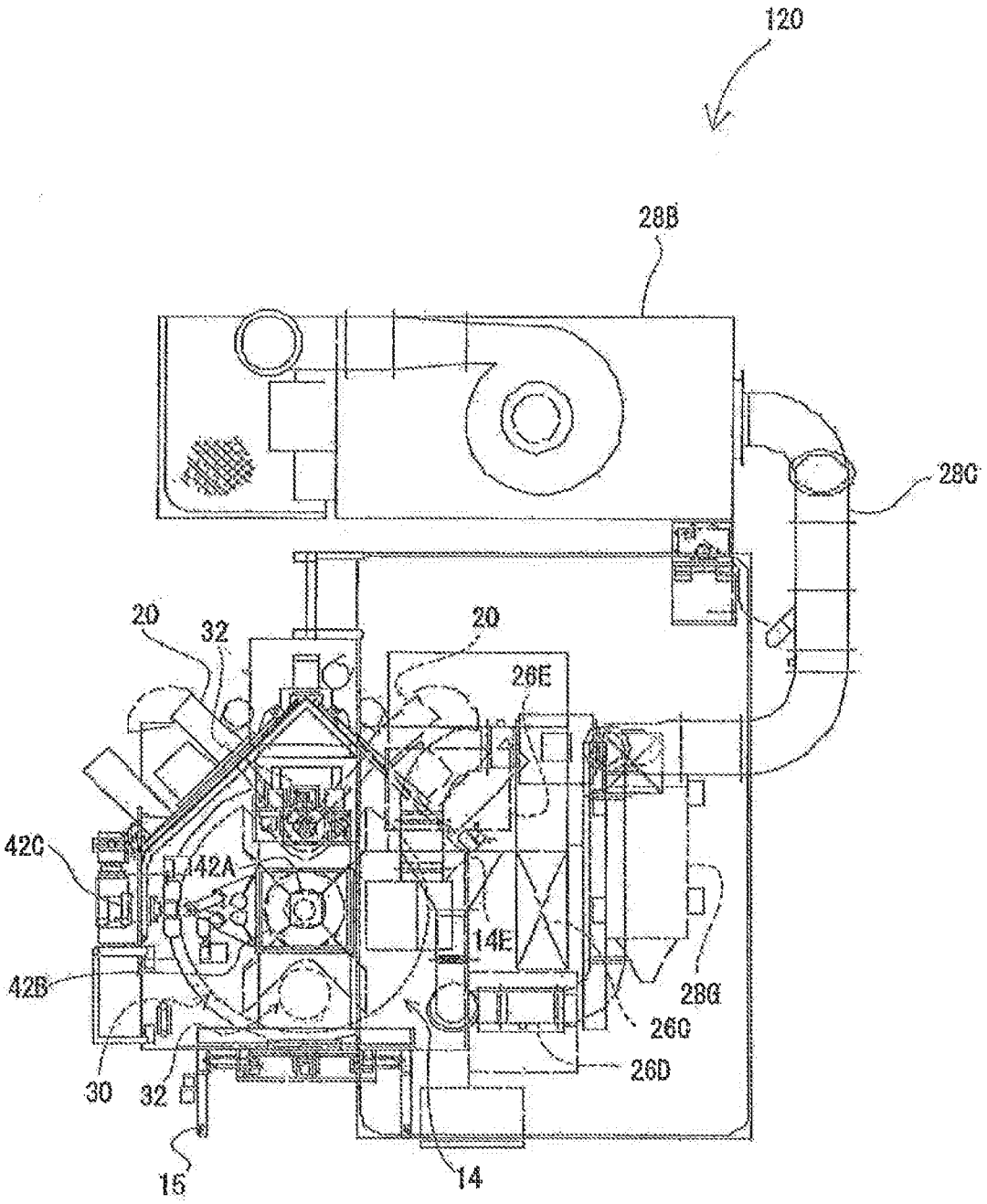
FIG. 14 is a plan view of the shot-peening apparatus of the third embodiment of the present invention.

Next, the shot-peening apparatus 120 that serves as a shot-processing apparatus of the third embodiment of the present invention is explained with reference to FIGS. 12, 13, and 14. FIG. 12 is a front view of the shot-peening apparatus 120. FIG. 13 is a right-side view of the shot-peening apparatus 120. FIG. 14 is a plan view of the shot-peening apparatus 120. Incidentally, the apparatus of the third embodiment has essentially the same configurations as those in the apparatus of the first embodiment except for the points explained below. So, the explanations of the components that have essentially the same configurations as those in the first embodiment are omitted. The same reference numbers used in the first embodiment are given to those components.

As in FIG. 12, a supplying tank 122 is disposed at a position near the lower part of the bucket elevator 26C. Further, a flow-regulating device 124 is disposed below the supplying tank 122. The flow-regulating device 124 is connected to the supplying tank 122. The flow-regulating device 124 has an openable valve. The flow-regulating device 124 can let the shot in the supplying tank 122 flow in an inlet at the lower end of the bucket elevator 26C when the valve is opened.

As in FIG. 13, a level meter 126 for detecting the amount of the shot in the tank 26F is attached to the tank 26E. The level meter 126 is connected to the control unit 64 (see FIG. 8). The control unit 64 controls the flow-regulating device 124 in FIG. 12 such that the valve of it is opened when the level meter 126 detects the amount of the shot in the tank 26F being less than a predetermined value. Thereby shot is supplied from the supplying tank 122 through the bucket elevator 26C, etc., into the tank 26F.

The shot-peening apparatus 120 has an ascending and descending door 128. A cylinder mechanism 130 for raising and lowering the ascending and descending door 128 is disposed above the cabinet 14. The cylinder mechanism 130 is a publicly-known air cylinder. The cylinder mechanism 130 comprises a rod 130A that can be extended and retracted along the vertical direction of the apparatus. The tip of the rod 130A is connected to the ascending and descending door 128. Namely, the ascending and descending door 128 ascends or descends along the vertical direction of the apparatus when the rod 130A of the cylinder mechanism 130 is retracted or extended.

The ascending and descending door 128 and the door of the flow-regulating device 24 (see FIG. 13) are closed while the large table 30 is being caused to rotate, so as to prevent the scattered shot, etc., from leaking and so as to ensure the safety of the apparatus while the large table 30 is rotating. The ascending and descending door 128 has a mechanism (not illustrated) for preventing the door 128 from tucking foreign materials. The mechanism is configured such that an area sensor 15 (see FIG. 13) is in operation while the ascending and descending door 128 is in operation. Thereby the mechanism prevents the ascending and descending door 128 from tucking foreign materials while the door is being closed. Incidentally, in this embodiment, the apparatus has a structure in which the air suctioned from an opening of the ascending and descending door 128 causes the dust generated in the cabinet 14 during a shot peening process to flow from the suction hole 14E via the settling chamber 28D within the duct 28C and into the dust collector 28B (see FIGS. 13 and 14).

The separator 26E in this embodiment is a separator having a rotary screen. This rotary screen is connected to the motor 26D for driving the bucket elevator 26C. Thus, the rotary screen is driven by the motor 26D.

Incidentally, the reference number "132" (not illustrated) denotes a driving motor for driving the screw conveyor 26B. The reference number "42A" denotes the motor having a decelerating device of the index device 42 in FIG. 14. The reference number "42B" denotes a positioning clamp. The reference number "42C" denotes a positioning cylinder. Those components have not yet been illustrated in the first embodiment. The positioning clamp 42B is disposed on a ceiling member of the cabinet 14.

The apparatus of the third embodiment, which has been explained above, also has the same functions and effects achieved by the apparatus of the first embodiment.

Supplemental Explanations of the Above Embodiments

Incidentally, in the above embodiments, the apparatus has a configuration in which the rotation-detecting sensor 66 for detecting the rotation of the holding member 48 is disposed as in FIG. 4, etc. Such a configuration is preferable in terms of determining whether shot is uniformly projected toward the entire workpiece 12. However, the apparatus is not limited to such a configuration. Namely, the apparatus may not have the rotation-detecting device.

In the above embodiments, the index device 42 causes the large table 30 to rotate around the rotating shaft 31 of the large table 30 by a predetermined angle corresponding to the positions of the small tables 32. However, for example, another configuration may be used, in it a position-detecting sensor for detecting the positions of the second rotatable tables is used, and in it the first rotatable table is caused to move (rotate) at predetermined time intervals by a particular angle corresponding to the detected positions of the second rotatable tables.

Figure 7:
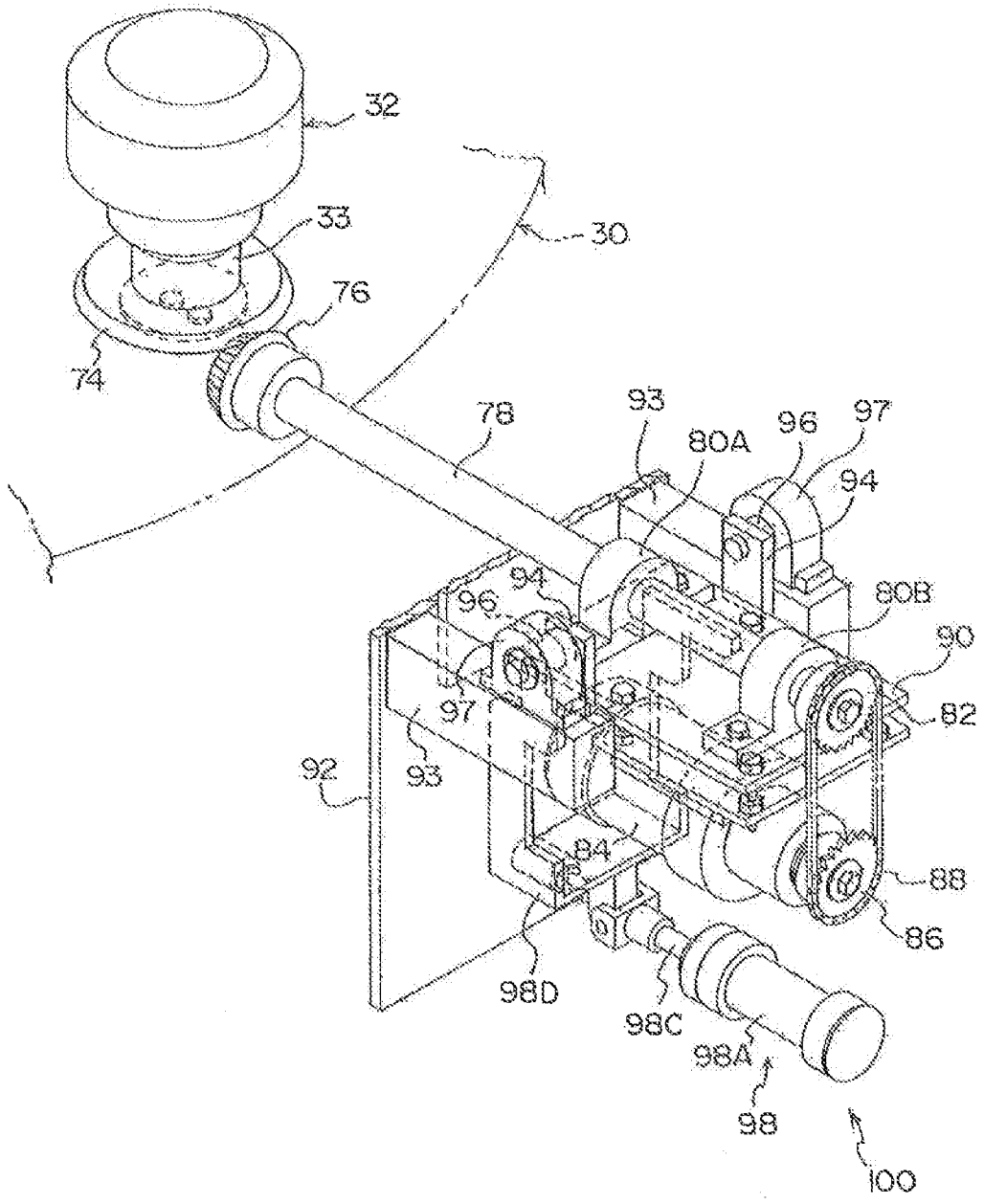
FIG. 7 is a perspective view illustrating a driving mechanism, etc., of a small table of the shot-peening apparatus of the first embodiment of the present invention.

In the above embodiments, the attaching and detaching mechanism 100 in FIG. 7, etc., includes the shaft 78. The second engaging part 76 contacts the first engaging part 74 while the large table 30 is being caused to stop temporarily. The second engaging part 76 is detached from the first engaging part 74 while the large table 30 is being caused to rotate. The above configuration is preferable for stable rotations of the small tables 32 and smooth rotation of the large table 30. However, the apparatus may not be configured in that way. For example, the attaching and detaching mechanism 100 may be omitted while a first rubber roller and a second rubber roller are used instead of the first engaging part and the second engaging part, respectively.

In the above embodiments, the air cylinder 98 of the attaching and detaching mechanism 100 can provide the shaft 78 with driving force that causes the second engaging part 76 to detach from the first engaging part 74. For example, the attaching and detaching mechanism may have a solenoid instead of the air cylinder 98 such that the solenoid can provide the shaft with driving force that causes the second engaging part to detach from the first engaging part. In another modified example, the air cylinder 98 in the above embodiments may be replaced with an oil cylinder.

In the above embodiments, the first engaging part 74 is fixed to the lower end of the rotating shaft 33 of the small table 32. However, the first engaging part may be integrally formed at the lower end of the rotating shaft of the second rotatable table. Also, in the above embodiments, the second engaging part 76 is fixed to the tip of the shaft 78. The second engaging part may be integrally formed at the tip of the shaft.

In the above embodiments, the driving motor 84 for causing the second engaging part 76 to rotate is disposed below the shaft 78. This configuration is preferable in making the apparatus smaller. However, the position at which the driving motor for causing the second engaging part to rotate is disposed may differ. For example, the driving motor may be disposed at a position on the extended line of the shaft. Further, the driving motor may have a decelerating device and a hollow shaft such that the second engaging part is driven when the hollow shaft of the driving motor is directly attached to an attaching shaft of the chain wheel 82.

In the above embodiments, the air cylinder 98 is disposed below the driving motor 84 such that the shaft of the air cylinder 98 is parallel to the direction of the shaft of the driving motor 84. This configuration is preferable in terms of making the apparatus smaller. However, the position at which the cylinder mechanism is disposed may differ. For example, the cylinder mechanism may be disposed at a position on the extended line of the shaft of the driving motor 84.

In the above embodiments, as in FIG. 5, the surface of the large table 30 is partitioned into the plurality of areas (30A, 30B) along the circumferential direction of the large table 30 by the plurality of partitioning members 44. The plurality of areas (30A, 30B) alternately comprise the first area 30A, on which each of the small tables 32 is placed, and the second area 30B, on which the no small table 32 is placed, along the circumferential direction of the first rotatable table. This configuration is preferable in preventing shot from leaking. However, for example, the surface of the large table 30 may be configured such that the small tables 32 are walled off by a sheet of a partitioning member while the surface of the large table 30 does not have the area (range) on which no small table 32 is placed (in other words, the small table 32 is disposed also in an area corresponding to the second area 30B of the above embodiments).

In the second embodiment, the spraying device 112 is configured such that the ducts 112C are connected to the member for supplying compressed air (not illustrated). However, the spraying device 112 is not limited to this. For example, another spraying device that can spray the gas introduced by a fan that can introduce air from outside the apparatus may be used as the spraying device 112.

In the above embodiments, the shot-processing apparatus of the present invention is configured as the shot-peening apparatuses 10, 110, and 120, each of which has the centrifugal projector 20. However, the shot-processing apparatus of the present invention may be a shot-blasting apparatus having the centrifugal projector 20.

Incidentally, the above embodiments and the above modifications may be appropriately combined.

DESCRIPTION OF THE REFERENCE NUMERALS

10 Shot-peening Apparatus (Shot-processing Apparatus)
12 Workpiece
20 Centrifugal Projector
30 Large Table (First Rotatable Table)
30A First Area
30B Second Area
32 Small Table (Second Rotatable Table)
42 Index Device
44 Partitioning Member
46 Holding Mechanism
48 Holding Member
64 Control Unit
66 Rotation Detection Sensor (Rotating Detecting Device)
74 First Engaging Part
76 Second Engaging Part
78 Shaft (Axial Member)
82 Chain Wheel (Mechanism for Transmitting Driving Force)
84 Driving Motor
86 Chain Wheel (Mechanism for Transmitting Driving Force)
88 Chain (Mechanism for Transmitting Driving Force)
98 Air Cylinder (Cylinder Mechanism)
100 Attaching and Detaching Mechanism
110 Shot-peening Apparatus (Shot-processing Apparatus)
112 Spraying Device

112A Nozzle

120 Shot-peening Apparatus (Shot-processing Apparatus)

I claim:

1. A shot-processing apparatus, wherein the apparatus comprises the following:

a centrifugal projector that centrifugally accelerates shot to project it toward workpieces;

a first rotatable table that is disposed at a position within an area that includes a projected area toward which the centrifugal projector projects shot and a non-projected area that is not the projected area;

a plurality of second rotatable tables disposed on the first rotatable table, wherein the workpieces are placed on a plurality of second rotatable tables, and wherein each of the second rotatable tables has a rotating shaft that is parallel to a rotating shaft of the first rotatable table such that each of the second rotatable tables can rotate;

a holding mechanism that is disposed above the projected area on the first rotatable table, wherein the holding mechanism comprises a holding member that can press down one of the workpieces onto one of the second rotatable tables, and wherein the holding member can rotate along with said one of the workpieces;

an index device and a control unit, wherein the index device causes the first rotatable table to rotate by a predetermined angle corresponding to respective positions of the second rotatable tables and around the rotating shaft of the first rotatable table, wherein the index device disposes some of the second rotatable tables in the projected area on the first rotatable table while the first rotatable table is being caused to stop temporarily, wherein the control unit stops the projection of shot from the centrifugal projector while the first rotatable table is being caused to rotate by means of the index device, and the control unit controls the centrifugal projector such that it projects shot while the first rotatable table is being caused to stop temporarily, wherein the apparatus further comprises the first engaging parts, a second engaging part, and an attaching and detaching mechanism, wherein the first engaging parts are disposed below the second rotatable tables, wherein the first engaging parts are formed on the respective rotating shafts of the second rotatable tables, wherein the second engaging part is disposed below the projected area on the first rotatable table, wherein the second engaging part can engage with each of the first engaging parts such that the second engaging part transmits rotational driving force to each of the first engaging parts while the second engaging part engages with each of the first engaging parts, wherein the attaching and detaching mechanism attaches the second engaging part to each of the first engaging parts while the first rotatable table is being caused to stop temporarily, and wherein the attaching and detaching mechanism detaches the second engaging part from each of the first engaging parts while the first rotatable table is being caused to rotate.

2. The shot-processing apparatus of claim 1, wherein the apparatus further comprises a rotation-detecting device for detecting a rotation of the holding member.

3. The shot-processing apparatus of claim 1 or 2, wherein the attaching and detaching mechanism comprises an axial member and a cylinder mechanism, wherein the second engaging part is disposed at the tip of the axial member, and wherein the cylinder mechanism can provide the axial member with driving force that detaches the second engaging part from each of the first engaging parts.

4. The shot-processing apparatus of claim 3, wherein a driving motor for driving the second engaging part is disposed below the axial member, wherein the driving motor causes the axial member to rotate via a mechanism for transmitting driving force.

5. The shot-processing apparatus of claim 4, wherein the cylinder mechanism is disposed below the driving motor, and wherein the axial direction of the cylinder mechanism is parallel to the axial direction of the driving motor.

6. The shot-processing apparatus of claim 1 or 2, wherein the first rotatable table is partitioned into a plurality of areas along a circumferential direction of the first rotatable table by a plurality of partitioning members, and wherein the plurality of areas alternately comprise a first area on which each of the second rotatable tables is placed and a second area on which no second rotatable table is placed, along the circumferential direction of the first rotatable table.

7. The shot-processing apparatus of claim 1 or 2, wherein the apparatus further comprises a spraying device that can spray gas toward a workpiece, wherein the spraying device is disposed such that its nozzle faces the workpiece and is located at a downstream position relative to the projected area on the first rotatable table along the direction of the rotation of the first rotatable table.

* * * * *